US011132960B1

(12) United States Patent
Wu et al.

(10) Patent No.: US 11,132,960 B1
(45) Date of Patent: Sep. 28, 2021

(54) BACKLIGHT DRIVING METHOD FOR A DISPLAY

(71) Applicant: MACROBLOCK. INC., Hsinchu (TW)

(72) Inventors: Yi-Ta Wu, Hsinchu (TW); Chun-Yi Li, Hsinchu (TW)

(73) Assignee: MACROBLOCK. INC., Hsinchu (TW)

( * ) Notice: Subject to any disclaimer, the term of this patent is extended or adjusted under 35 U.S.C. 154(b) by 0 days.

(21) Appl. No.: 17/301,021

(22) Filed: Mar. 22, 2021

(30) Foreign Application Priority Data

Mar. 26, 2020 (TW) ..... 109110130

(51) Int. Cl.
*G09G 3/34* (2006.01)

(52) U.S. Cl.
CPC ..... *G09G 3/342* (2013.01)

(58) Field of Classification Search
None
See application file for complete search history.

(56) References Cited

U.S. PATENT DOCUMENTS 6,151,016 A * 11/2000 Kanbe ..... G09G 3/3677 345/204
7,760,170 B2 * 7/2010 Bae ..... G09G 3/3216 345/82
2003/0063108 A1 * 4/2003 Isono ..... G09G 3/22 345/690
2004/0207315 A1 * 10/2004 Robbie ..... H01L 27/3293 313/504
2010/0110097 A1 * 5/2010 Nam ..... G09G 3/3648 345/589
2018/0018924 A1 * 1/2018 Mao ..... G09G 3/3406

* cited by examiner

*Primary Examiner* — Matthew Yeung
(74) *Attorney, Agent, or Firm* — MLO, a professional corp.

(57) ABSTRACT

A backlight driving method is provided to include generating switching signals based on an internal synchronization control (ISC) signal related to refreshing of images on the display, a clock signal, and delay commands contained in a serial input signal that further contains an image stream. A time delay of each switching signal with respect to the ISC signal is determined by the clock signal and a respective delay command, and the time delays of the switching signals are different from one another. The method further includes generating driving signals based on the ISC signal, the clock signal and the serial input signal; and outputting the signals thus generated, to drive the backlight module to emit light in a line scan manner.

12 Claims, 3 Drawing Sheets

BACKLIGHT DRIVING METHOD FOR A DISPLAY

CROSS-REFERENCE TO RELATED APPLICATION

This application claims priority of Taiwanese Patent Application No. 109110130, filed on Mar. 26, 2020.

FIELD

The disclosure relates to display driving techniques, and more particularly to a backlight driving method for a display.

BACKGROUND

In a liquid crystal display (LCD), light emitted by a backlight module passes through a liquid crystal layer by a variable amount, and is filtered by a color filter, so as to produce color images. The liquid crystal layer has a long response time. If all light emitting diodes (LEDs) of the backlight module emit light continuously, the phenomenon of drag could occur when the LCD displays dynamic images.

One conventional way to alleviate drag is to temporarily turn off the backlight module upon each frame change (i.e., inserting black frames), thereby reducing image display time. However, this method reduces the time the backlight module is turned on, so the light emitted by the backlight module must have higher luminous intensity to achieve the desired level of display brightness. In addition, the LEDs of the backlight module are simultaneously switched from not emitting light to emitting light, so the LCD generates high electromagnetic interference (EMI).

SUMMARY

Therefore, an object of the disclosure is to provide a backlight driving method that can alleviate the drawbacks of the prior art.

According to the disclosure, the backlight driving method is to be implemented by a driver module of a display, and is adapted to drive a backlight module of the display to emit light in a line scan manner. The backlight driving method includes: (A) generating a plurality of switching signals based on an internal synchronization control signal, a clock signal, and a plurality of delay commands contained in a serial input signal, the internal synchronization control signal being related to refreshing of images on the display, the serial input signal further containing an image stream, wherein for each of the switching signals, a time delay of the switching signal with respect to the internal synchronization control signal is determined by the clock signal and a respective one of the delay commands, and the time delays of the switching signals are different from one another; (B) generating, based on the internal synchronization control signal, the clock signal and the serial input signal, a plurality of driving signals that correspond to the switching signals in time; and (C) outputting the switching signals and the driving signals to drive the backlight module to emit light in the line scan manner.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
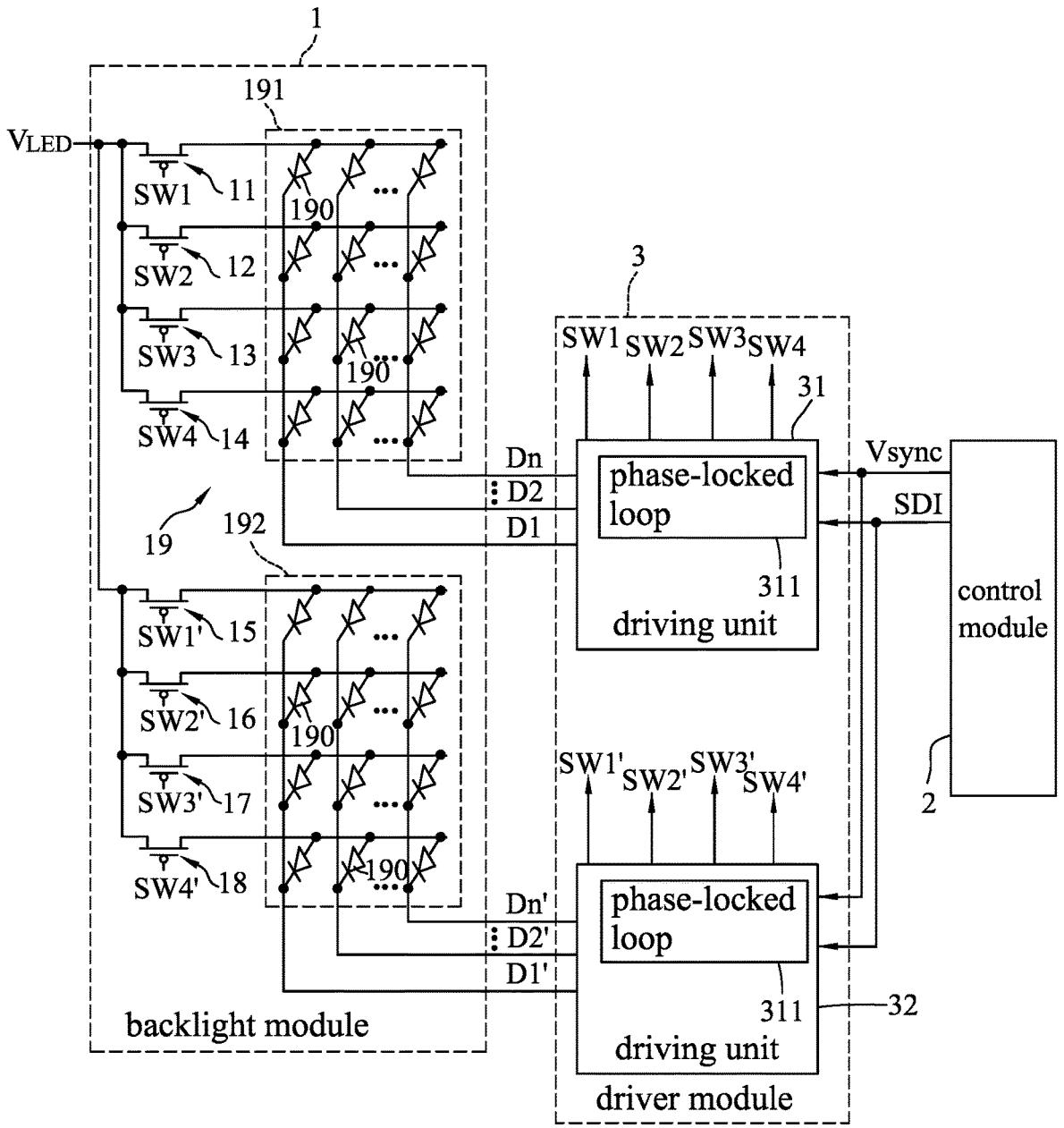
FIG. 1 is a circuit block diagram illustrating a display to implement an embodiment of a backlight driving method according to the disclosure.

Referring to FIG. 1, an embodiment of a backlight driving method according to the disclosure is to be implemented in a display. In an example, the display is a scan-type display (e.g., a liquid crystal display (LCD)), is capable of displaying dynamic images (e.g., supporting dynamic frame rate technologies), and includes a backlight module 1, a control module 2, a driver module 3, and a display module (e.g., an LCD panel) (not shown). The backlight driving method of this embodiment is to be implemented by the driver module 3, and is adapted to drive the backlight module 1 to emit light in a line scan manner (i.e., light emitted in lines).

The backlight module 1 includes a plurality of switches and a light emitting diode (LED) array 19. The switches are divided into a plurality of switch groups. The LED array 19 includes a plurality of LEDs 190 that are divided into a plurality of LED groups. For illustration purposes, there are two switch groups each including four switches 11-14 or 15-18, and there are two LED groups 191, 192 each including four rows of LEDs 190. For each of the switch groups and a respective one of the LED groups 191, 192, each of the switches 11-14 or 15-18 (e.g., a P-type metal oxide semiconductor field effect transistor (pMOSFET)) has a first terminal (e.g., a source terminal) that is to receive an input voltage ($V_{LED}$), a second terminal (e.g., a drain terminal) that is coupled to first terminals (e.g., anodes) of the LEDs 190 in a respective one of the rows, and a control terminal (e.g., a gate terminal).

It should be noted that while the switches 11-18 are included in the backlight module 1 in the example, they may be included in the driver module 3 or be independent of the backlight module 1 and the driver module 3 in other examples. In addition, each row of the LED array 19 corresponds to a respective line of the line scan of the display (namely, a respective line of the display that emits light in each line scan cycle).

The control module 2 generates an original synchronization control signal (Vsync), and a serial input signal (SDI) that contains a plurality of delay commands and an image stream. The image stream is generated by a graphics processing unit (GPU) (not shown) of the control module 2, and contains multiple pieces of image data that respectively correspond to multiple images or image frames to be shown by the display. Each of the delay commands indicates a delay value. The delay values indicated by the delay commands form an arithmetic progression with a positive common difference. In other words, the delay value indicated by an $(m+1)^{th}$ delay command is greater than the delay value indicated by an $m^{th}$ delay command by the common difference, where $1 \leq m \leq M-1$, and M is a total number of the delay commands. The delay commands are divided into a plurality of delay command groups. For illustration purposes, there are two delay command groups each including four delay commands, with a first delay command group of the two including first to fourth delay commands, and a second delay command group of the two including fifth to eighth delay commands.

The driver module 3 is coupled to the backlight module 1 and the display module, is further coupled to the control module 2 to receive the original synchronization control signal (Vsync) and the serial input signal (SDI) therefrom, and drives the backlight module 1 and the display module based on the original synchronization control signal (Vsync) and the serial input signal (SDI). The driver module 3 includes a plurality of driving units. For illustration purposes, there are two driving units 31, 32. Each of the driving units 31, 32 is coupled to the control module 2, to the switches 11-14 or 15-18 of a respective one of the switch groups, and to second terminals (e.g., cathodes) of the LEDs 190 of a respective one of the LED groups 191, 192, and includes a phase-locked loop 311 that generates a respective clock signal (PLL) (see FIG. 3). The clock signals (PLL) generated by the phase-locked loops 311 of the driving units 31, 32 are substantially the same (i.e., having substantially the same frequency, and being substantially synchronous to each other). It should be noted that the driving units 31, 32 may be fabricated on a single chip or on two separate chips.

Figure 2:
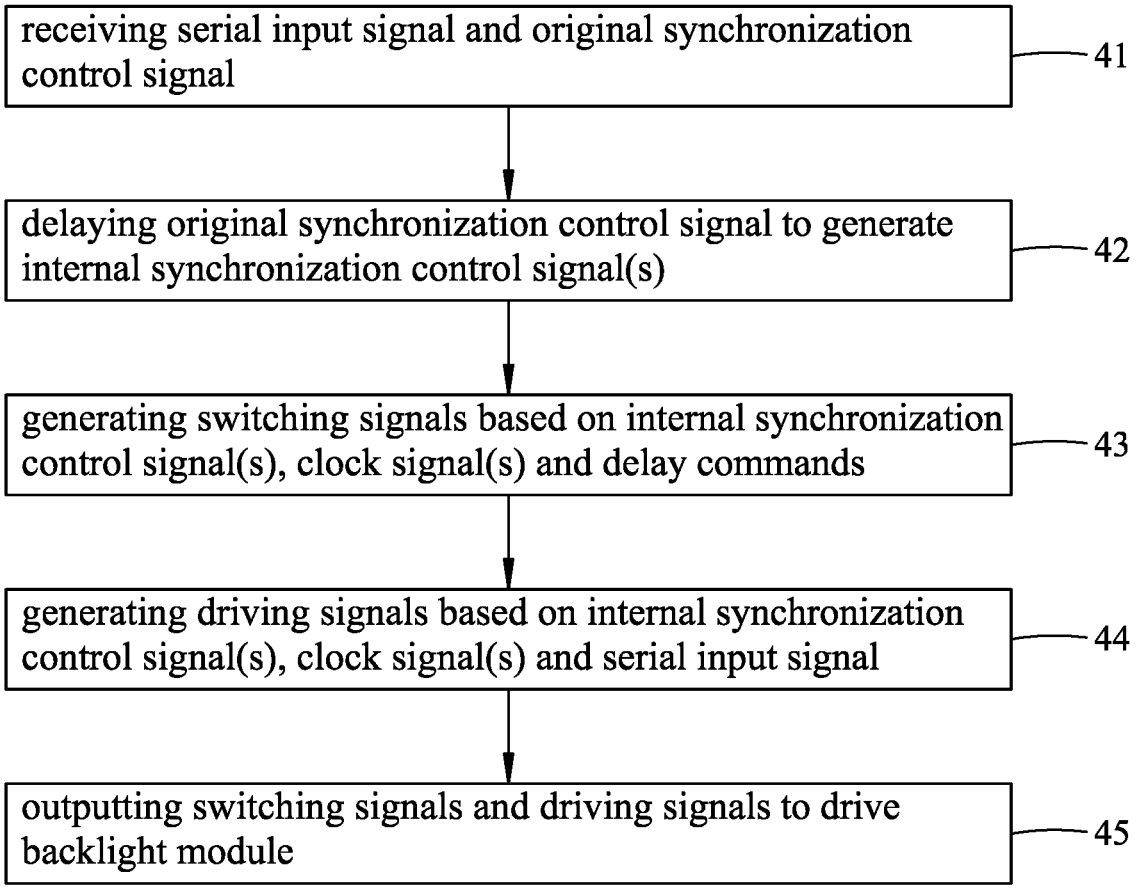
FIG. 2 is a flow chart illustrating the embodiment.
Figure 3:
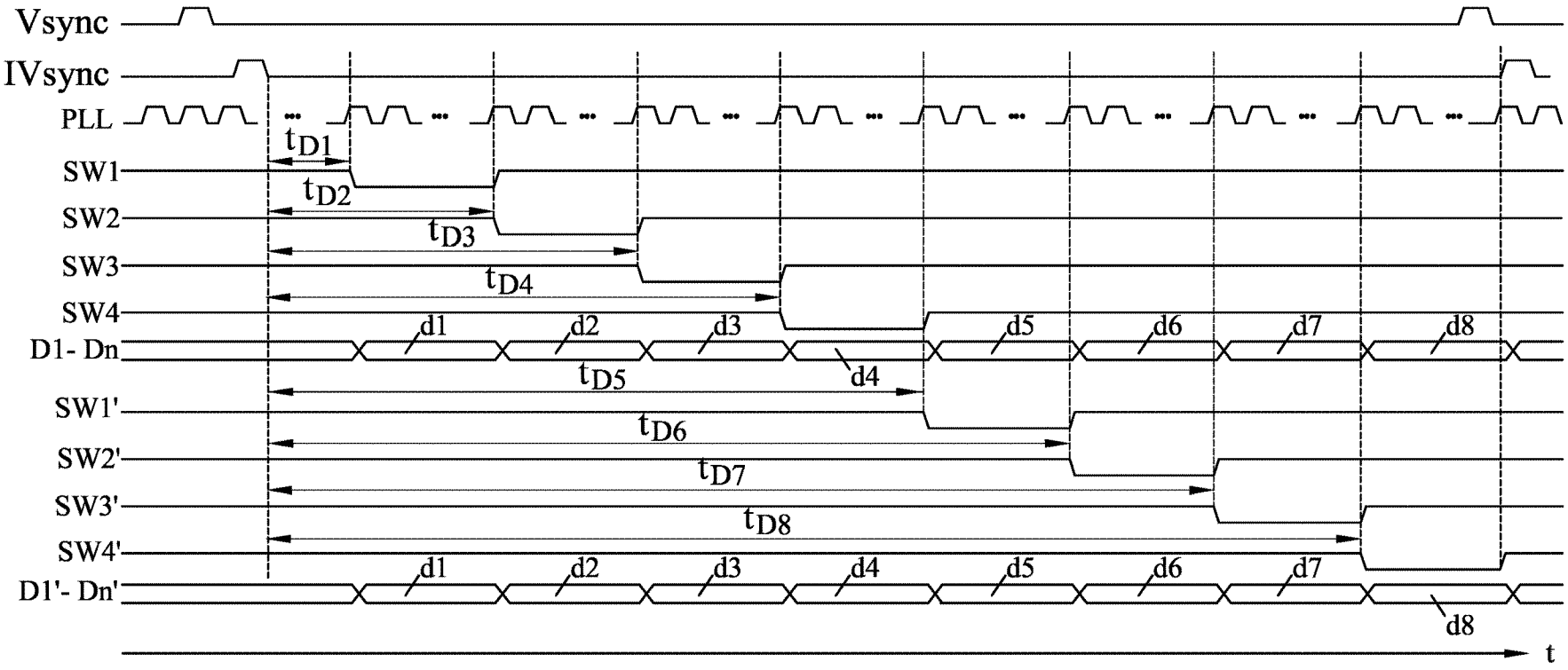
FIG. 3 is a timing diagram illustrating an original synchronization control signal, an internal synchronization control signal, a clock signal, multiple switching signals and multiple driving signals of the embodiment.

Referring to FIGS. 1 to 3, the backlight driving method of this embodiment includes the following steps 41-45.

In step 41, the driver module 3 receives the serial input signal (SDI) and the original synchronization control signal (Vsync) from the control module 2.

Specifically, each of the driving units 31, 32 receives the serial input signal (SDI) and the original synchronization control signal (Vsync) from the control module 2.

In step 42, the driver module 3 delays the original synchronization control signal (Vsync) to generate a plurality of internal synchronization control signals (IVsync) that are related to image updates (or refreshing of images) of the display (an image update is the act of the display switching from displaying a current image or image frame to displaying a next image or image frame), and that are substantially the same (i.e., being substantially synchronous to each other).

Specifically, each of the driving units 31, 32 delays the original synchronization control signal (Vsync) to generate a respective one of the internal synchronization control signals (IVsync).

In step 43, the driver module 3 generates a plurality of switching signals based on the internal synchronization control signals (IVsync) generated thereby, the clock signals (PLL) generated thereby, and the delay commands.

In detail, the switching signals are divided into a plurality of switching signal groups. For illustration purposes, there are two switching signal groups, each including four switching signals (SW1-SW4 or SW1'-SW4'). Each of the driving units 31, 32 generates the switching signals (SW1-SW4 or SW1'-SW4') of a respective one of the switching signal groups based on the internal synchronization control signal (IVsync) generated thereby, the clock signal (PLL) generated thereby, and the delay commands of a respective one of the delay command groups. In this embodiment, each of the switching signals (SW1-SW4, SW1'-SW4') and the internal synchronization control signals (IVsync) is a pulse signal. A time delay of each of the switching signals (SW1-SW4, SW1'-SW4') with respect to the corresponding internal synchronization control signal (IVsync) (e.g., a time interval ($t_{D1}/t_{D2}/t_{D3}/t_{D4}/t_{D5}/t_{D6}/t_{D7}/t_{D8}$) between a pulse of the switching signal and a pulse of the corresponding internal synchronization control signal (IVsync) that occurs immediately before the pulse of the switching signal) is determined by the corresponding clock signal (PLL) and a respective one of the delay commands. Each of the driver units 31, 32 includes a counter (not shown). For any one of the switching signals (SW1-SW4, SW1'-SW4'), the counter of the corresponding driving unit 31/32 is configured to count, based on the corresponding clock signal (PLL), from zero to the delay value indicated by the corresponding delay command, and starts the counting at an end of each pulse of the corresponding internal synchronization control signal (IVsync) to obtain the corresponding time interval ($t_{D1}/t_{D2}/t_{D3}/t_{D4}/t_{D5}/t_{D6}/t_{D7}/t_{D8}$). The switching signals (SW1-SW4, SW1'-SW4') have the same pulse width that is a predetermined multiple of a period of each of the clock signals (PLL), where the predetermined multiple is smaller than or equal to the common difference of the arithmetic progression formed by the delay values indicated by the delay commands. Therefore, the pulses of the switching signals (SW1-SW4, SW1'-SW4') are staggered and non-overlapping in time. In other words, within each line scan cycle, the pulse of the switching signal (SW1), the pulse of the switching signal (SW2), the pulse of the switching signal (SW3), the pulse of the switching signal (SW4), the pulse of the switching signal (SW1'), the pulse of the switching signal (SW2'), the pulse of the switching signal (SW3'), and the pulse of the switching signal (SW4') occur one by one without overlapping one another in time.

In step 44, the driver module 3 generates, based on the internal synchronization control signals (IVsync) generated thereby, the clock signals (PLL) generated thereby, and the serial input signal (SDI), a plurality of driving signals that correspond to the switching signals (SW1-SW4, SW1'-SW4') in time.

In detail, the driving signals are divided into a plurality of driving signal groups. For illustration purposes, there are two driving signal groups, each including multiple driving signals (D1-Dn or D1'-Dn'). Each of the driving units 31, 32 generates the driving signals (D1-Dn or D1'-Dn') of a respective one of the driving signal groups based on the internal synchronization control signal (IVsync) generated thereby, the clock signal (PLL) generated thereby, the image stream, one of the delay commands that indicates a smallest one of the delay values (i.e., the first delay command), and the common difference of the arithmetic progression formed by the delay values indicated by the delay commands. Each of the driving signals (D1-Dn, D1'-Dn') has a current magnitude that is related to the luminous intensity of the light emitted by the LED array 19, that is determined by the image stream, and that changes upon starting points of the pulses of the switching signals (SW1-SW4, SW1'-SW4').

In step 45, the driver module 3 outputs the switching signals (SW1-SW4, SW1'-SW4') and the driving signals (D1-Dn, D1'-Dn') to drive the backlight module 1 in the line scan manner.

Specifically, each of the driving units outputs the switching signals generated thereby respectively to the control terminals of the switches of the respective one of the switch groups, and outputs the driving signals generated thereby to the respective one of the LED groups. In the example, the driving unit 31 outputs the switching signals (SW1-SW4) respectively to the control terminals of the switches 11-14, and outputs the driving signals (D1-Dn) to the LED group 191; and the driving unit 32 outputs the switching signals (SW1'-SW4') respectively to the control terminals of the switches 15-18 and outputs the driving signals (D1'-Dn') to the LED group 192. For each of the driving units 31, 32 and the respective one of the LED groups 191, 192, each of the driving signals (D1-Dn or D1'-Dn') generated by the driving unit 31 or 32 is to be received by the second terminals of the LEDs 190 in a respective column of the LED group. Each of the switches 11-18 conducts within each pulse of one of the switching signals (SW1-SW4, SW1'-SW4') that is received thereby, and does not conduct outside each pulse of said one of the switching signals (SW1-SW4, SW1'-SW4'). Each of the LEDs 190 of the LED array 19 emits light when one of the switches 11-18 that is coupled to the LED 190 conducts, and does not emit light when said one of the switches 11-18 does not conduct; and the luminous intensity of the LED 190 is determined by one of the driving signals (D1-Dn, D1'-Dn') that is received by the LED 190. Since the switches 11-18 conduct one by one (because the pulses of the switching signals (SW1-SW4, SW1'-SW4') are staggered and non-overlapping in time, as discussed previously), the LEDs 190 of the LED array 19 emit light row by row (i.e., the backlight module 1 emits light in the line scan manner).

In this embodiment, for any one of the internal synchronization control signals (IVsync), a starting point of each pulse of the internal synchronization control signal (IVsync), except the first pulse, is concurrent with an end point of a pulse of one of the switching signals (SW1-SW4, SW1'-SW4') that corresponds to a last line of the line scan in each line scan cycle (i.e., the switching signal (SW4') in FIG. 3).

Moreover, the driver module 3 generates a drive output based on the image stream and one of the internal synchronization control signals (IVsync), and outputs the drive output to the display module, such that the display shows the images or image frames represented by the image stream, and refreshing of images on the display is synchronous to the line scan of the display (i.e., an image update of the display occurs when a line scan cycle of the backlight module 1 ends). In this embodiment, light transmittance of the display module varies according to the image stream, and light emitted by the backlight module 1 is modulated by the display module to produce the images or image frames represented by the image stream. Therefore, by virtue of the driver module 3 generating the drive output based on said one of the internal synchronization control signals (IVsync), image tearing or image interruption can be prevented to attain better display quality.

It should be noted that, in this embodiment, each of the driving units 31, 32 generates the respective clock signal (PLL) and the respective internal synchronization control signal (IVsync). However, in other embodiments, the driver module 31 may generate only one clock signal (PLL) and only one internal synchronization control signal (IVsync) for common use by the driving units 31, 32.

In view of the above, in this embodiment, by virtue of the driver module 3 generating the switching signals (SW1-SW4, SW1'-SW4') based on the internal synchronization control signals (IVsync), the clock signals (PLL) and the delay commands, the pulses of the switching signals (SW1-SW4, SW1'-SW4') can be staggered and non-overlapping in time, so the backlight module 1 can emit light in the line scan manner (i.e., inserting black lines) to alleviate drag. In addition, time of light emission of the LEDs 190 in each of the rows of the LED array 19 in this embodiment is increased when compared to a comparable device from the current state of the art. Consequently, the increased time of light emission in the present embodiment will require a lower luminous intensity to achieve parity in perceived brightness, allowing each of the LEDs 190 of the LED array 19 to extend its lifetime. Moreover, the LEDs 190 of the LED array 19 are not simultaneously switched from not emitting light to emitting light, so the display generates low electromagnetic interference (EMI).

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A backlight driving method to be implemented by a driver module of a display, and adapted to drive a backlight module of the display to emit light in a line scan manner, said backlight driving method comprising steps of:

(A) generating a plurality of switching signals based on an internal synchronization control signal, a clock signal, and a plurality of delay commands contained in a serial input signal, the internal synchronization control signal being related to refreshing of images on the display, the serial input signal further containing an image stream, wherein for each of the switching signals, a time delay of the switching signal with respect to the internal synchronization control signal is determined by the clock signal and a respective one of the delay commands, and the time delays of the switching signals are different from one another;

(B) generating, based on the internal synchronization control signal, the clock signal and the serial input signal, a plurality of driving signals that correspond to the switching signals in time; and (C) outputting the switching signals and the driving signals to drive the backlight module to emit light in the line scan manner.

2. The backlight driving method of claim 1, wherein:

each of the delay commands indicates a delay value; and in step (B), the driving signals are generated based on the internal synchronization control signal, the clock signal, the image stream, and one of the delay commands that indicates a smallest one of the delay values which are indicated by the delay commands.

3. The backlight driving method of claim 1, wherein:

each of the delay commands indicates a delay value; and the delay values indicated by the delay commands form an arithmetic progression with a positive common difference.

4. The backlight driving method of claim 1, wherein:

each of the internal synchronization control signal and the switching signals is a pulse signal; and for any one of the switching signals, the time delay of the switching signal with respect to the internal synchronization control signal is a time interval between a pulse of the switching signal and a pulse of the internal synchronization control signal that occurs immediately before the pulse of the switching signal.

5. The backlight driving method of claim 4, wherein the pulses of the switching signals occur one by one without overlapping one another in time.

6. The backlight driving method of claim 4, wherein each of the driving signals changes upon starting points of the pulses of the switching signals.

7. The backlight driving method of claim 1, the driver module including a plurality of driving units, wherein:

the delay commands are divided into a plurality of delay command groups;

the switching signals are divided into a plurality of switching signal groups; and step (A) includes by a first one of the driving units, generating the switching signals of a first one of the switching signal groups based on the internal synchronization control signal, the clock signal and the delay commands of a first one of the delay command groups, and by a second one of the driving units, generating the switching signals of a second one of the switching signal groups based on the internal synchronization control signal, the clock signal and the delay commands of a second one of the delay command groups.

8. The backlight driving method of claim 1, the driver module including a plurality of driving units, wherein:

the driving signals are divided into a plurality of driving signal groups; and step (B) includes by a first one of the driving units, generating the driving signals of a first one of the driving signal groups based on the internal synchronization control signal, the clock signal and the serial input signal, and by a second one of the driving units, generating the driving signals of a second one of the driving signal groups based on the internal synchronization control signal, the clock signal and the serial input signal.

9. The backlight driving method of claim 1, the backlight module including a plurality of switches and a light emitting diode (LED) array, the switches being divided into a plurality of switch groups, the LED array including a plurality of LED groups, wherein:

the switching signals are divided into a plurality of switching signal groups;

the driving signals are divided into a plurality of driving signal groups; and in step (C), the switching signals of each of the switching signal groups are outputted to the switches of a respective one of the switch groups, and the driving signals of each of the driving signal groups are outputted to a respective one of the LED groups.

10. The backlight driving method of claim 1, further comprising steps of:

(D) receiving the serial input signal and an original synchronization control signal from a control module; and (E) delaying the original synchronization control signal to generate the internal synchronization control signal;

wherein steps (D) and (E) are executed before execution of step (A).

11. The backlight driving method of claim 10, wherein:

each of the internal synchronization control signal and the switching signals is a pulse signal; and a starting point of each pulse of the internal synchronization control signal is concurrent with an end point of a pulse of one of the switching signals that corresponds to a last line of the line scan in each line scan cycle.

12. The backlight driving method of claim 1, wherein, for each line of the line scan in each line scan cycle, the decision to emit light for the line is determined by a respective one of the switching signals, and luminous intensity of the line, when emitting the light, is determined by the driving signals.

* * * * *